US007313917B2

(12) United States Patent
Yeghiazarian et al.

(10) Patent No.: US 7,313,917 B2
(45) Date of Patent: Jan. 1, 2008

(54) VOLUME PHASE TRANSITION TO INDUCE GEL MOVEMENT

(75) Inventors: Lilit L. Yeghiazarian, Los Angeles, CA (US); Ulrich Wiesner, Ithaca, NY (US); Carlo D. Montemagno, Los Angeles, CA (US)

(73) Assignee: Cornell Research Foundation, Inc., Ithaca, NY (US)

( * ) Notice: Subject to any disclaimer, the term of this patent is extended or adjusted under 35 U.S.C. 154(b) by 438 days.

(21) Appl. No.: 10/880,602

(22) Filed: Jul. 1, 2004

(65) Prior Publication Data

US 2006/0001008 A1 Jan. 5, 2006

(51) Int. Cl.
*F01B 29/10* (2006.01)

(52) U.S. Cl. ..... 60/527; 60/508; 60/513

(58) Field of Classification Search ..... 60/527, 60/528, 529, 508, 513, 515
See application file for complete search history.

(56) References Cited

U.S. PATENT DOCUMENTS 2,610,583 A * 9/1952 Miller ..... 60/528
2,835,634 A * 5/1958 Vernet et al. ..... 252/1
3,027,729 A * 4/1962 Chace ..... 62/135
3,184,914 A * 5/1965 Cole ..... 60/529
4,716,031 A * 12/1987 Eckenhoff et al. ..... 424/453
5,474,785 A * 12/1995 Wright et al. ..... 424/473
5,971,288 A * 10/1999 Davis et al. ..... 236/68 R
6,524,274 B1 2/2003 Rosenthal et al.
6,565,872 B2 5/2003 Wu et al.
6,698,510 B2 3/2004 Serva et al.
6,753,191 B2 6/2004 Asher et al.

OTHER PUBLICATIONS

Tanaka, T., et al, Science 218, 467-469 (1982).
Okajima, T., et al, J. Chem. Phys. 116(20), 9068-9077 (2002).
Z-6040 Silane Product Information Dow Corning (1997).
Joanny, J-F, et al, Physical Review Letters, 90(16) 168102-1-168102-4.
Ilavsky, J., et al, "X-ray scattering studies of structural changes in swollen macromolecular networks after abrupt temperature changes", 2 pages undated.

* cited by examiner

*Primary Examiner*—Hoang Nguyen
(74) *Attorney, Agent, or Firm*—Bacon & Thomas, PLLC

(57) ABSTRACT

Movement of a gel structure is propagated by successively applying external stimuli to cause volume phase transition in the gel structure by alternately causing the gel structure to collapse and swell to move the center of mass of the gel structure in the direction of successive stimuli application. The movement is mediated by confining structure for the gel and anchoring—the starting side of the gel in the swelling cycle.

26 Claims, 4 Drawing Sheets

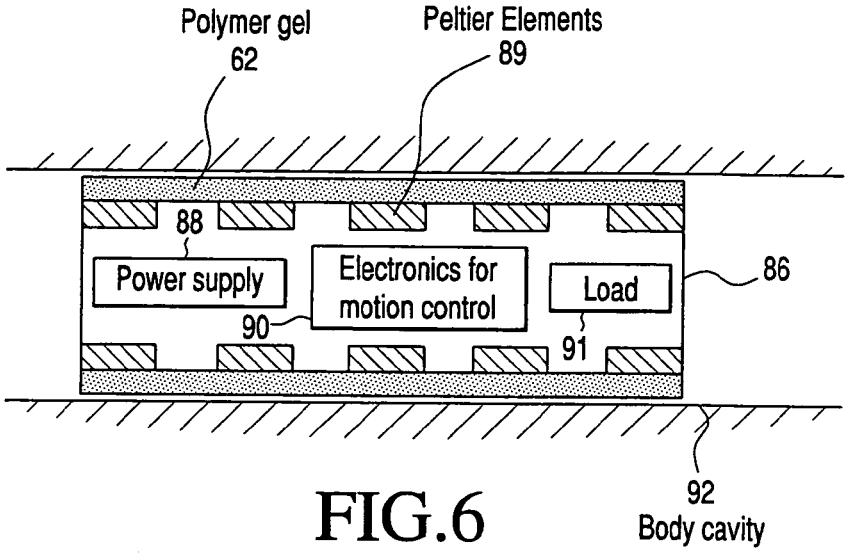
FIG.6
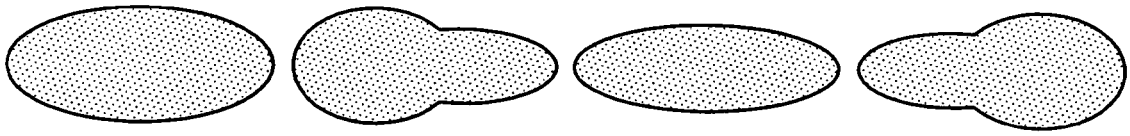
FIG.7A FIG.7B FIG.7C FIG.7D
FIG.7E
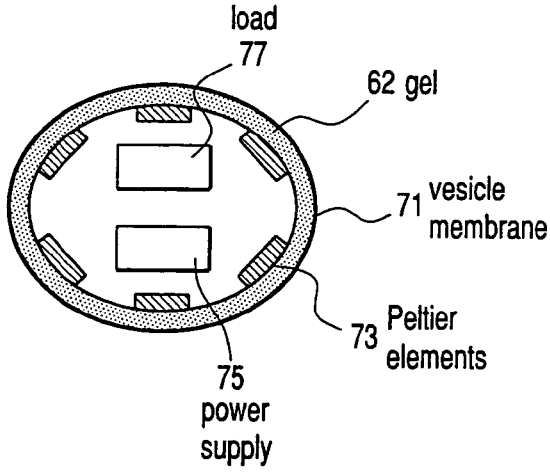

VOLUME PHASE TRANSITION TO INDUCE GEL MOVEMENT

This invention was made at least in part with Government support under Grant No. 2001-35102-09871 from the United States Department of Agriculture. The United States Government has certain rights in the invention.

TECHNICAL FIELD

This invention is directed at a method for propagating movement of a gel structure.

BACKGROUND OF THE INVENTION

Polymer gels consisting of cross-linked polymer networks immersed in a solvent are known to undergo reversible volume phase transitions upon small changes in the environment. See Tanaka, T., et al, Science 218, 467-469 (1982) and Okajima T., et al, J. of Chem. Phys. 20 (116), 9068-9077 (2002). However, this property has not heretofore been used to move the center of mass of the gel.

SUMMARY OF THE INVENTION

It has been discovered herein that applying two or more stimuli to alternately collapse and swell a confined gel structure in a predetermined sequence will cause movement of the gel structure in a desired direction. Initial expansion of a first section/segment/portion of a shrunken gel blocks the passageway of the confining structure and prevents subsequent expansion of an adjacent second section of the shrunken gel in that direction. Thus expansion of the second section applies a force against the blockage and occurs in the direction not obstructed by blockage and will move the center of mass of the gel structure away from the blockage. In effect, the expanding second section "pushes off" the blockage.

One embodiment of the invention herein denoted the first embodiment is directed to a method for propagating movement of an elongated gel structure having a first end and an other end and length and transverse dimensions, in the direction of its length, comprising applying one or more external stimuli starting at its first end and thereafter along its length to its other end, to cause a volume phase transition in the gel structure progressively along its length to move the center of mass of the gel structure in the direction of successive stimuli application. In other words, this embodiment involves application of one or more alternating stimuli in sequence to the gel to move it. Preferably the elongated gel structure has an aspect ratio of greater than 1 where the length dimension is greater than the transverse dimension, which, for example, ranges from 20 to 80.

In a first example of the first embodiment, the method comprises the steps of (a) providing an elongated confining passageway defined by at least one wall and having an entrance end and an exit end longitudinally removed from one another, and a transverse dimension; (b) providing in a minor portion of the passageway, preferably for practical purposes at or near its entrance end, a swollen reversibly collapsible gel structure, so that the gel structure is confined by said at least one wall and has a first end preferably at or near said entrance end of the passageway, e.g., within from 5 to 10 mm of said entrance end, and an other end longitudinally removed from said first end; (c) applying stimuli to the confined gel structure starting at its first end and then successively along its length to progressively induce a volume phase transition from said first end along the length of the gel structure to progressively collapse said gel structure and move the center of mass of the gel structure toward said exit end and provide a gel structure of reduced volume compared to that of step (b) having a first end longitudinally moved toward said exit end of the passageway and an other end longitudinally positioned about the same (since the progressive collapsing will induce some shrinkage also at said other end) as the other end in step (b) and having transverse dimension smaller than that of the confining passageway; (d) applying stimuli to the reduced volume gel structure at its moved first end to swell the moved first end in a transverse direction to anchor the gel structure to said at least one wall at said moved first end and also to swell the gel structure at the moved first end in a longitudinal direction and to move the other end of the gel structure toward the exit end of the confining passageway and successively applying stimuli along the length of the reduced volume gel structure to progressively induce volume phase transition to swell the gel structure along its entire length, thereby causing movement of the center of mass of the gel structure toward said exit end and optionally continuing the sequence of stimuli application. The direction of gel movement can be reversed when desired by reversing the direction of stimuli application. The initial state of the gel is not necessarily swollen; for example, the gel in the confining passageway can initially be in collapsed state and stimuli, e.g., cooling, applied in the desired direction of movement to swell it, whereupon movement is propagated by successively collapsing and swelling, etc., in said desired direction of movement.

In one subset of the first example of the first embodiment, the passageway contains a piston abutting the first end or the other end of the elongated gel structure and movement of the center of mass of the gel structure toward said exit end, causes movement of the piston toward said exit end, and, if the piston is downstream of the gel structure or upstream but attached to it, movement of the center of mass of the gel structure away from said exit end causes movement of the piston away from said exit end.

In a second subset of the first example of the first embodiment, the gel structure has a drug entrapped therein which by movement of the center of mass of the gel structure is propelled from the passageway in the gel structure for introduction into a patient for controlled release of the drug into the patient.

In a third subset of the first example of the first embodiment, a load is appended to the gel structure by means of mechanical, physical or chemical attachment and is pushed or pulled through the passageway by movement of the gel structure.

In the first example of the first embodiment, the at least one wall is preferably the inner wall of a circular cross section tube.

In a second example of the first embodiment, said at least one wall comprises an outer rigid wall and an inner flexible wall of a structure with an opening therethrough, e.g., an annular structure, and induction of volume phase transition moves the flexible wall so as to induce movement of a fluid through the opening.

Another embodiment of the invention herein denoted the second embodiment is directed to pushing or pulling apparatus comprising (a) confining structure; (b) reversibly collapsible gel structure within the confining structure; (c) a load within the confining structure upstream or downstream of the gel structure; (d) stimulus applicator for causing collapsing and/or swelling of the gel structure; whereby operation of stimulus applicator progressively collapses and swells the gel structure to move the load.

Another embodiment herein, denoted the third embodiment, is directed to load moving apparatus comprising:

(a) a housing having an outer surface, (b) reversibly collapsible gel structure in moving causing or mediating relationship with the housing, (c) a load in the housing, (d) stimulus applicator in the housing for causing collapsing and/or swelling of the gel structure, whereby operation of the stimulus applicator successively and progressively causes collapsing and/or swelling of the gel structure to move the housing and the load.

In one alternative for the third embodiment, the housing is flexible and outer surface thereof is coated with the gel structure.

In a second alternative of the third embodiment, the housing is rigid and the gel structure is contained in flexible receptacles in engagement with said outer surface.

Another embodiment herein, denoted the fourth embodiment, comprises:

(a) a notched wheel, (b) a pawl having a notched wheel engaging end and an other end, (c) collapsible gel structure having one end attached to the other end of the pawl and other end for attachment to an immobile surface.

The gel structure for the embodiments herein is preferably a polymer gel (i.e., a gel formed by crosslinking of a polymer, e.g., a hydrogel (a polymeric material which exhibits the ability to swell in water and to retain a significant portion of water within its structure without dissolution)) and very preferably is a poly-N-isopropylacrylamide hydrogel and the stimuli to induce volume phase transition involving collapsing comprises application of a temperature above the lower critical solution temperature (LCST) and stimuli to induce volume phase transition involving swelling comprises application of a temperature below the LCST.

The transition conditions of a gel are the conditions under which the gel undergoes a phase transition, e.g., a volume phase transition. Where causing temperature change is the stimulus that causes phase transition, e.g., collapse and swelling of a gel, a gel is preferably selected where the transition temperature is within 15 degrees centigrade of room temperature. For poly-N-isopropylacrylamide gels the transition temperature is about 33.5° C.

The term "volume phase transition" is used herein to mean a significant change in volume induced by a small change in the environment.

BRIEF DESCRIPTION OF THE DRAWINGS

FIG. 6 is a schematic representation of a device moving in a body cavity.

FIGS. 7A-7D constitute schematics showing a geometrical sequence of vesicle shapes that result in rectilinear self-propulsion.

FIG. 7E discloses in cross section a vesicle having a flexible membrane housing a heating element, power supply.

DETAILED DESCRIPTION

Figure 1:
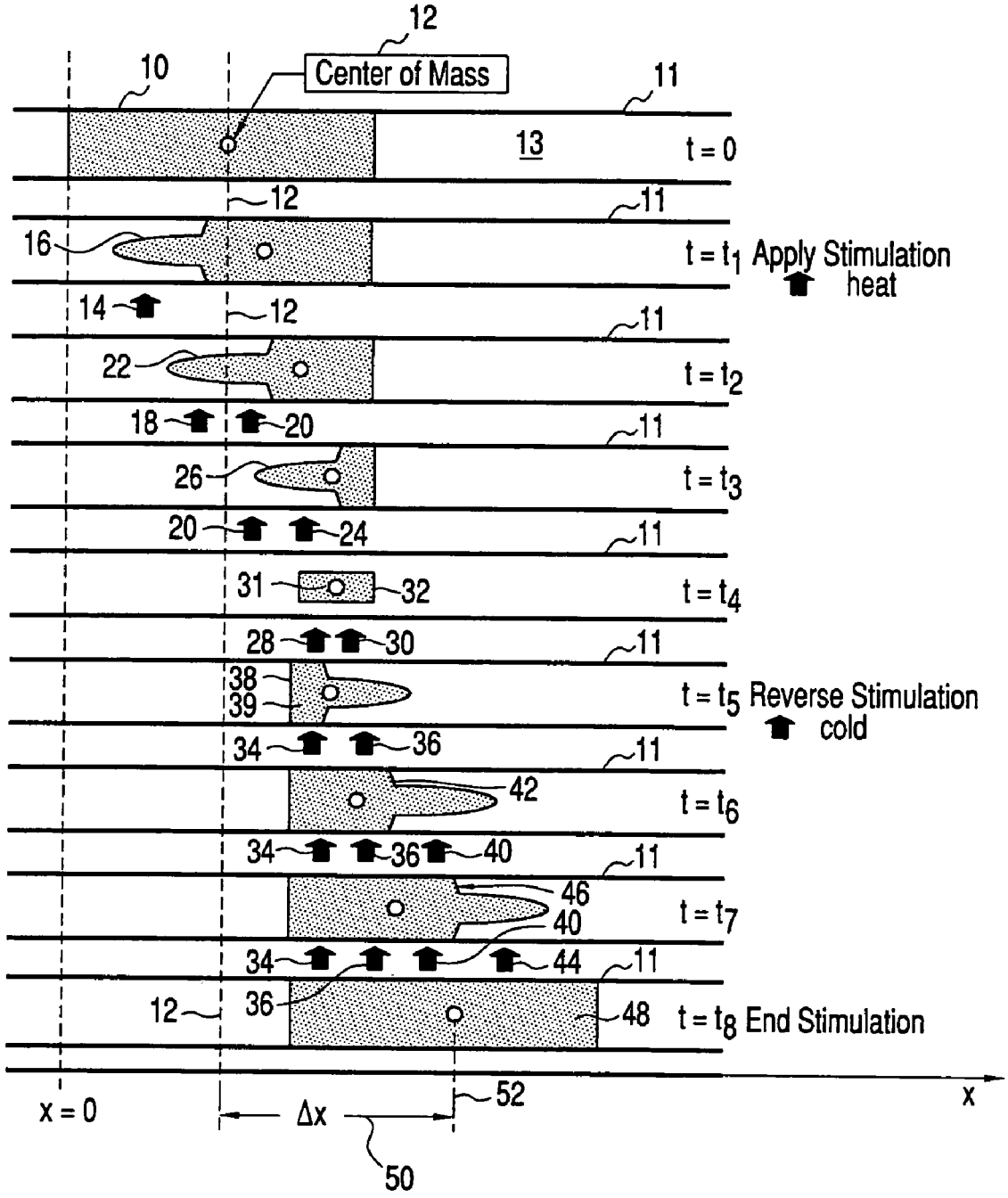
FIG. 1 is a schematic representation of progressive collapsing and swelling of a gel to move the center of mass of the gel in accordance with the first embodiment of the invention.

With continuing reference to FIG. 1, there is shown in schematic a series of volume phase transitions. A thermosensitive swollen gel structure is indicated at 10 for t (time)=0. The gel structure is confined in a tube 11. The center of mass of the gel structure at t=0 is indicated at 12. The portion of the tube not occupied by the gel structure is filled with water as shown at 13. At time=$t_1$ heating stimulus is applied at position 14 to cause rise of temperature in the adjacent gel structure to collapse and shrink a first portion of the gel structure as indicated at 16. At t=$t_2$, heating elements at positions 18 and 20 are used to successively apply heat to the gel adjacent thereto to cause rise in temperature above the transition temperature to cause further shrinkage of the gel toward the other end of the gel as indicated at 22. At t=$t_3$ heating elements at positions 20 and 24 are used to successively heat the gel progressively along its further length to cause further collapse and shrinkage as indicated at 26 so as to provide at t=$t_4$ via successive application of heating elements at positions 28 and 30 a reduced volume gel structure 31 of reduced transverse dimension and shrinking in a longitudinal direction including a very small amount of shrinkage (not shown) at the end 32. At time=$t_5$, reverse stimulation successively at positions 34 and 36 (i.e. application of cold to reduce the temperature of adjacent gel structure below the transition temperature) is applied to swell the gel as indicated at 39 both toward the left and toward the right and in the transverse direction to cause the gel structure moved first end to butt against the wall of confining structure 11 adjacent thereto to anchor the gel structure at end 38 against the confining structure 11 (caused by reverse stimulation at 34) and fill and block passageway of the confining structure in the vicinity of the anchoring so that further swelling and expansion (caused by reverse stimulation at 36) will move the gel structure other end and center of mass to the right. For example, with a gel structure with an aspect ratio of 50:1 longitudinal to transverse dimension, swelling to increase diameter 1 unit will increase the length 50 units. At t=$t_6$, further successive application of cold at positions 34, 36 and 40 causes further swelling to the right as indicated at 42. At t=$t_7$, further successive application of cold at positions 34, 36 40 and 44 to cause the temperature in the adjacent gel structure to fall below the transition temperature of the gel causes further swelling of the gel as indicated at 46 whereupon at t=$t_8$ the gel is fully swollen as indicated at 48 and stimulus in the form of reduction in temperature is terminated. The center of mass of the fully swollen gel 48 is at 52 whereby the center of mass has moved a distance of $\Delta x$ as indicated at 50.

During the collapsing/swelling, the net volume of gel plus solvent (water) in the tube 11 in theory remains the same.

The stimuli are applied to propagate the volume phase transition along the gel structure beginning at the starting end of the gel structure and move the center of mass of the gel structure away from entrance end. The starting end defines the movement propagating direction which is in a direction away from the starting end of the gel structure toward the other end of the initial gel structure and, if desired, there beyond.

The thermosensitive polymeric hydrogel used for demonstrating the concept of the invention herein was a thermosensitive poly-N-isopropylacrylamide gel (PNIPAA) prepared from 700 mM N-isopropylacrylamide monomer (NIPA) and 26 mM of N,N'-methylenebisacrylamide as the cross-linker as described in Okajima, T., et al J. of Chem. Phys. 116 (No. 20), 9068-9077 (5/2002). The poly-N-isopropylacrylamide gel used was a hydrogel, that is water was contained in the gel structure, and in the remainder of the tube. Alternatively other solvents can be used, if other gels are to be utilized.

While a thermosensitive gel structure was utilized, other gel structures undergoing reversible volume phase transition in response to temperature stimuli or other stimuli can be used.

The the stimuli can be, for example, temperature change, solvent composition change, pH change, electromagnetic radiation including visible and UV light, selective electrical field direction, ion concentration and the like.

For example, partially hydrolyzed acrylamide gels in a solvent such as 50:50 acetone-water mixture which undergo reversible volume transitions upon small changes in temperature, solvent composition, pH, concentration of added salt, and application of electrical field across the gel, can be used for the invention herein.

Temperature sensitive gels for use herein, besides poly-N-isopropylacrylamide gels include, for example, R-acrylamide gels where R is H or $C_1$-$C_6$-alkyl, $R_1$ acrylate gels where $R_1$ is H or $C_1$-$C_6$-alkyl, $R_2$-acrylic acid gels where $R_2$ is H or $C_1$-$C_6$-alkyl, polyethylene glycol gels, N-vinylpyrrolidone gels, agarose gels, methacrylate gels, poly(N,N-diethylacrylamide gels, polyvinyl methyl ether gels and acrylamide/acrylic acid gels. pH sensitive gels include, for example, poly(acrylamide) gels and methacrylamidophenylboronic acid gels. Visible light sensitive gels include, for example, copolymers of N-isopropylacrylamide and chlorophyllin. UV light sensitive gels include, for example copolymers of N-isopropylacrylamide and (4-dimethylamino)phenyl)(4-vinylphenyl)methyl leucocyanide.

For thermosensitive gels of small volume, Peltier elements, e.g, 9×9 mm Peltier elements connected in parallel to a DC power supply can be used for stimuli application; these function as heat pumps and change the direction of heat transfer depending on the polarity of the DC voltage. In a test of the invention herein, a plurality of Peltier elements were used with each element being individually connected to the power supply through a switch. A paste, e.g. thermal conductive grease, may be applied to the outside of the confining structure, e.g., tube 11, for better heat conduction. For a smaller scale case, gold resistive heating elements are useful for causing increase of temperature above the transition temperature; cooling is a passive scenario.

An anti-stick compound is preferably coated on the inside of the confining structure so that the anchored swollen end of the gel structure does not become permanently attached. The anti-stick compound should make the wall of the confining structure that abuts the gel structure, hydrophobic. A suitable compound for this purpose is diethoxydimethylsilane coated on the inner tube surface as a dilute aqueous solution (0.1 to 0.5 percent silane concentration) by adjusting the pH of the water to 3.5 to 4.5 with about 0.1 percent acetic acid and then adding the silane and then stirring for about 15 minutes before the silane hydrolyzes and forms a clear homogenous solution and then applying the homogenous solution to the inner tube surface, and curing, preferably at 113° C. for at least 30 minutes.

In the experiments carried out, the confining wall was a glass tube of circular transverse cross-section. However, other transverse cross-section confining structures, e.g., square or rectangle or other tetragon, or trapezoid or other cross-section, can be used. The gels used in the experiments were 4.1 cm long and 0.7 mm wide in diameter, which makes the aspect ratio about 58.6.

Figure 2:
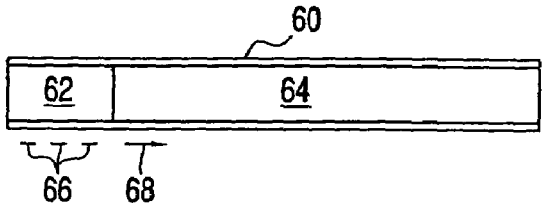
FIG. 2 is a schematic representation of a longitudinal cross-section of a tube containing a gel structure and the application of volume phase transition.

With reference to FIG. 2, there is depicted a glass tube 60, containing a PNIPAA hydrogel 62 at one end and a body of water 64 in the rest of the tube. Peltier elements 66 are schematically shown at the left end of the tube and the arrow 68 schematically indicates Peltier elements along the length of the tube and switched on successively in the direction of the arrow. The first of Peltier elements adjacent the hydrogel, are wired to cause heating. The next set of Peltier elements adjacent the hydrogel, are wired to cause cooling. Volume phase transition is induced at the first end of gel structure 62 by heating up the faces of the first one or two elements. The part of the gel adjacent to the hot elements collapses within seconds, while the rest of its body remains unaffected. As the gel shrinks from one end, its center of mass moves toward the other end. The next 1 or 2 elements are then heated and so on until the entire gel collapses leading to significant transitional motion of the center of mass in one direction. The element or elements used should be of sufficient length for the purpose desired. After the gel is fully collapsed, volume phase transition is reversed by locally cooling the gel from the same end that was first heated. This is accomplished by using the first one or two Peltier elements in contact with the first end of the collapsed gel to cause cooling to provide sufficient cooling length for the butting described later, while the next Peltier elements are kept at a temperature above the transition temperature of the gel. The cooled end of the gel swells until it butts against the glass wall of the tube and anchors the first end of the gel structure to the glass wall by applying pressure against the wall of the tube. The collapsed part of the gel is not hindered by the glass wall and moves. Then the next 1 or 2 Peltier elements (to provide sufficient cooling length for the purpose described) are switched to cooling mode and so on, so swelling propagates to the right along the gel and the center of mass continues moving in the same direction until the gel is fully swelled. The sequence of events is then repeated. As a result gel movement is induced in a selected direction by anisotropically applying volume phase transition along the length of the gel by applying stimuli locally and progressively in the direction selected forcing phase transition to propagate along the length of the gel in the selected direction.

In one variation of the invention, the gel structure 62 has a drug entrapped therein which by movement of the center of mass of the gel structure is propelled from glass tube 60 in the gel structure for introduction or injection into a patient for controlled or sustained release of the drug in the patient. For this utility, the drugs may be reacted with free carboxyls in monomer for example, with free carboxyl in N-isopropylacrylamide before cross-linking to form polymer gel to form covalent bonds between drug and the monomer or the drug can be physically encapsulated or entrapped by the monomer and thereafter by the gel formed from the monomer. The drug is released by metabolic action in the patient's body and the attachment to or entrapment in or encapsulation with gel delays release, for example, for 2 to 48 hours or more. For example with a channel of 1 μm diameter, the hydrogel with drug therein might be propelled into the patient with speeds on the order of meters per second. Sufficiently small passageways implement velocities sufficient to inject materials though cellular membranes, including skin. To make sure that the gel is expelled from the tube completely, as the front end of the gel is out and in the target, the heating elements opposite tube 60 can be turned on quickly to ensure that the last segment of the gel is collapsed; the elastic properties of the gel will insure that the last segment of the gel will follow the rest. Alternatively, a segmented gel can be employed with a mechanism to separate the last portion of the gel from the rest.

Figure 3:
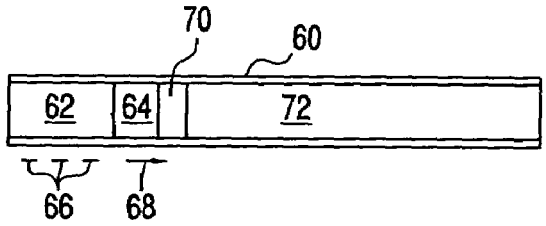
FIG. 3 is a schematic representation of an example of the first embodiment used to move a piston, depicted in longitudinal cross-section.

With reference to FIG. 3, glass tube 60 contains gel 62 and body of fluid 64 and Peltier elements are schematically represented at 66 and continue along the length of the tube as indicated by arrow 68 and are successively switched on to provide heating and gel collapse and then cooling and gel swelling to propagate gel movement in the direction of arrow 68. A difference between FIG. 3 and FIG. 2 is that the glass tube 60 contains a piston 70 and body of liquid 72 downstream of the piston, e.g., a sample to be analyzed, and the apparatus of FIG. 3 is used to drive piston 70 to propel sample 72, for example, on a microchip for analysis, or containing a drug to be expelled for administration. For this purpose, the glass tube can have a transverse cross-section diameter, ranging, for example, from microns to millimeters for a circular transverse cross-section tube. Another difference from the operation of FIG. 2 is that there is a liquid inlet (not shown) to supply liquid back of piston 70 as it moves forward.

Figure 4:
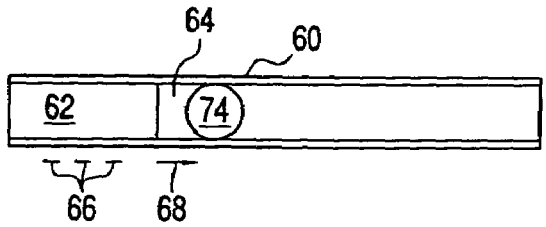
FIG. 4 is a schematic representation of an example of the first embodiment used to move a load different from a piston, depicted in longitudinal cross-section.

With reference to FIG. 4, the scenario is the same as for FIG. 2 with glass tube 60, reversibly collapsible gel 62, a solvent 64, Peltier elements 66 and scenario as indicated by arrow 68. The difference is that the tube 60 contains a load 74, e.g., a medical device to be inserted, in a tissue or body cavity. After the device is inserted, the gel is caused to retract into the tube by reversing the direction of movement of the gel. While the load is shown as filling the cross section of the channel of tube 60, it can be of lesser cross section than that of the channel of tube 60 so liquid downstream of the load will leak around the load as the gel moves it forward. In the case where the load has the same cross section as the tube 60, a liquid inlet (not shown) is provided to supply liquid back of the load as it is moved forward. The load 74 can be of any shape.

Figure 5:
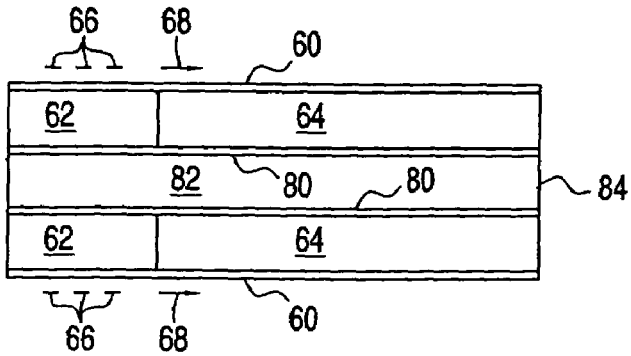
FIG. 5 is a schematic representation of the second example of the first embodiment herein, depicted in longitudinal cross-section.

With reference to FIG. 5, there is schematically depicted the second example of the first embodiment. With continuing reference to FIG. 5, there is depicted an annular structure with outer glass wall 60 and inner flexible wall tube 80, for example, made of rubber, with the annulus defined by relative position of tube 60 and tube 80 containing hydrogel 62 and solvent 64 with heating and cooling scenario shown at 66 and 68. The tube 80 contains a fluid 82 to be propelled. Induction of volume phase transition in gel 62 in the direction of arrow 68 flexes the wall of tube 80 and alternately causes it to expand and contract in sinusoidal fashion to propel the fluid 82 through tube 80 and out of opening 84 thereof. The stimuli are applied, for example, to cause the gel to assume a dumbbell shape to impart sine wave configuration to the encasing annular structure and movement of the sine wave configuration progressively along wall 80 to move fluid 82 through the opening 84.

So far as FIGS. 2, 3 and 4 are concerned, liquid 64 is provided to provide liquid for uptake into the gel.

So far as the tube 60 is concerned for FIGS. 2 and 4, in cases where liquid forward of the gel reconstitutes the gel, the length of the tube should be sufficiently larger than the length of the gel to allow reconstitution.

With reference to FIG. 6, there is depicted a device that is a housing 86 with reversibly collapsible gel 62 together with water in a flexible sack or flexible sacks (not shown) attached to the outer surface of the housing with small reservoirs (not shown) within the device where water will be transferred as it is expelled from the gel so there is a change in volume in the sack or sacks so there will be waves and movement of the device as the gel undergoes phase transition. The housing 86 contains an internal power supply 88, Peltier elements 89, and electronics 90 to control the Peltier elements, to apply stimulation to the gel to control swelling and collapsing. The housing 86 also contains a load 91, which is a microchip or a capsule with a drug that is for delivery at a certain point or a digital camera or miniature recording equipment for investigation. The device is positioned, for example, in an intestine 92 and inner surface of the intestine serves as the confining passageway. Collapsing and swelling are successively carried out in the direction of desired movement to move the housing in the intestine to where the load is required. The device will be a rather large device for intestinal use; however, the gel structure can be one structure or a plurality of structures acting in synch.

Alternatively, the device can touch only part of the intestinal wall and the waves in the gel will move it along the wall without confining passageways.

To control free motion of a similar device in a liquid environment, independently controlled sack of gel can be provided on each side of the device, preferably on four sides and waves in each sack are modulated to change the velocity vector of one side relative to other sides. For example, on a symmetrical device, all sides operating in synch provide straight ahead motion. To turn, opposite sides are modulated, one side with faster waves, one side with slower waves. To turn quickly, the waves on one side are eliminated and the waves on the opposite side are implemented opposite to the direction of turn.

With reference to FIG. 7E, there is shown in cross section a vesicle (e.g., a (microrobotic machine)) with flexible membrane 71 housing heating elements 73, power supply 75, electronics (not shown) and load 77 with a reversibly collapsible polymerized gel 62 deposited thereon. The vesicle is immersed in a fluid, e.g., a liquid, and the electronics control the swelling/shrinking scenario to cause the vesicle to assume a succession of shapes as shown in FIGS. 7A, 7B, 7C and 7D to provide self propelling movement. If the vesicles are sufficiently small, they can be used in veins/arteries without significantly obstructing blood flow. Larger scale vesicles can be used for marine/fresh water explorations. An important feature of these devices is that they do not require a confining passageway to move, yet their movement is still based on anisotropic volume phase transition.

Figure 8:
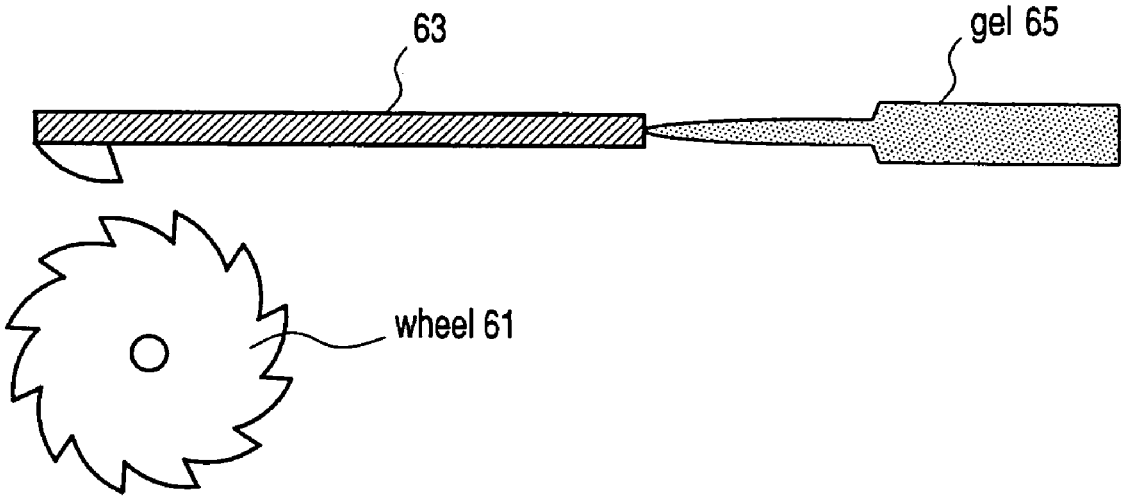
FIG. 8 depicts a gel volume phase transition driven ratchet mechanism for imparting rotary motion.

With reference to FIG. 8, there is shown a ratchet mechanism with a notched wheel 61 and a downwardly biased pawl 63. A reversibly collapsible gel 65 is anchored at its right end to an immobile surface and its left end is attached to the pawl 63. As the gel is swollen, the gel is moved to the left to move the pawl to the left whereupon the downward biasing causes the pawl to hook onto a tooth of wheel 61. As the gel is collapsed, it drags the pawl causing the wheel 61 to move clockwise.

The invention is also useful for load transport in microfluidic devices where the locomotion is controlled by embedded stimuli that locally heat/cool the gel.

We turn now to a case of a device for moving a load which relies on and comprises a plurality of gel structures of smaller scale than the load. The load can be of any size, e.g., from micron-scale centimeter or larger-scale, and the individual gel structures need only be enough smaller than the load that the plurality of gel structures can simultaneously apply a force to the load.

Small diameter gels, e.g., confined in tubes of small diameter, have much faster volume phase transition times than gels of larger diameter since the reaction time of a gel is largely cross-section determined, and therefore move/react to stimulation extremely rapidly. To take advantage of this effect and increase the speed at which a load is moved, a plurality of confined smaller diameter gels, e.g., each being of diameter or transverse dimension on the order of microns, e.g., 1-50 microns, or even less than 1 micron as enabled by published information and available technology, are operated in synchronization to obtain the fast propulsion effects of small dimension gels for propelling the larger load. Each small diameter generates a small force and the plurality of small forces are such as to move the load; the size and location of each small diameter gel (force applicator) is determined by size constraints. For example, with a load having a radius three times that of a gel structure (assuming circular cross-section), e.g., 3 microns, 5-9 gel structures of radius 1 micron might be used to push against the load. Below is a table of radius versus circular cross-section for comparison:

TABLE

| Radius | Circular Cross-Section |
|---|---|
| 1 | 3.1 |
| 2 | 12.6 |
| 3 | 28.3 |
| 4 | 50.3 |
| 5 | 78.5 |
| 6 | 113.1 |
| 7 | 153.9 |
| 8 | 201.1 |
| 9 | 254.5 |
| 10 | 314.2 |
| 11 | 380.1 |
| 12 | 452.4 |
| 13 | 530.9 |
| 14 | 615.8 |
| 15 | 706.9 |

As is evident from the above, this embodiment is not limited to application to large loads, but can also be used with small radius loads in combination with even smaller radius gel structures. For example one, might move a 100 micron radius load very fast using 100 or 1,000 one-micron radius gels to push it. The requirement is that the plurality of gel structures together have a cross section equal to or less than that of the load. With speed up being non-linear with cross-section reduction, using two structures containing the same amount of gel as a single structure will result in movement that is more than twice as fast. This embodiment is useful, for example, to provide a compartmented element (e.g., with a plurality of small diameter compartments) with each compartment containing gel, used for example, to move a video device, e.g., for gastrointestinal examinations.

To obtain movement of a gel with increased precision, an initial portion of swollen gel structure is collapsed and then sweelled before a succeeding portion of the gel structure is collapsed, so that the entire body of gel structure is not collapsed or swollen at one time, e.g., similar to worm motion. For, example, only a portion of an elongated gel structure is subjected to volume phase transition which is reversed before a next portion of the elongated gel structure is subjected to volume phase transition, whereby elongation is propagated segmentally.

The invention herein is useful in respect to microelectromechanical systems (MEMS) and nanoelectromechanical systems (NEMS). An important benefit in this context, is that the invention can cause velocities varying with the square of the diameter of encasing structure. As indicated above, the speeds of gel movement obtained can be expected to reach orders of meters per second for micron sized gels, which is much faster than movement on a similar scale in biological organisms.

Variations

Other variations of the invention will be obvious to those skilled in the art from the above. Thus, the scope of the invention is defined by the claims.

What is claimed is:

1. A method for propagating movement of an elongated gel structure having a first end and an other end, in the direction of its length, comprising applying one or more external stimuli in successive applications starting at its first end and thereafter progressively to portions of the elongated gel structure along its length from the first end to the other end, to cause a volume phase transition in the gel structure along its length to move the center of mass of the gel structure in the direction of successive applications.

2. The method of claim 1 where the elongated gel structure has an aspect ratio of greater than 1 where the length dimension is greater than the transverse dimension.

3. A method for propagating movement of an elongated gel structure having a first end and an other end in the direction of its length; where the elongated gel structure has an aspect ratio greater than 1 where the length dimension is greater than the transverse dimension; comprising the steps of:

(a) providing an elongated confining passageway defined by at least one wall and having an entrance end and an exit end longitudinally removed from one another, and a transverse dimension, (b) providing in a minor portion of the passageway a swollen reversibly collapsible elongated gel structure, so that the gel structure is confined by said at least one wall and has a first end and an other end longitudinally removed from said first end, (c) applying one or more external stimuli to the confined gel structure starting at its first end and then successively along its length to progressively induce a volume phase transition from said first end along the length of the gel structure to the other end to progressively collapse said gel structure to cause volume phase transition in the gel structure along its length and move the center of mass of the gel structure in the direction of successive applications toward said exit end and provide a gel structure of reduced volume compared to that of step (b) having a first end longitudinally moved toward said exit end and an other end longitudinally positioned about the same as the other end in step (b), (d) applying one or more external stimuli to the reduced volume gel structure at its moved first end to induce volume phase transition and swelling at said moved first end to swell the moved first end in a transverse direction to anchor the gel structure to said at least one wall at said moved first end and also to swell the gel structure at the moved first end in a longitudinal direction and to move the other end of the gel structure toward the exit end of the confining passageway and successively applying stimuli along the length of the reduced volume gel structure to progressively induce volume phase transition to swell the gel structure along its entire length, thereby causing movement of the center of mass of the gel structure in the direction of successive applications toward said exit end.

4. The method of claim 3 where the gel of the gel structure is a poly-N-isopropylacrylamide gel and the stimuli to induce the volume phase transition involving collapsing comprise application of a temperature above the transition temperature of the gel and the stimuli to induce volume phase transition involving swelling comprising application of a temperature below the transition temperature of the gel.

5. The method of claim 3 where the passageway contains a piston adjacent to the first or the other end of elongated gel structure, and movement of the center of mass of the gel structure toward said exit end, causes movement of the piston toward said exit end.

6. The method of claim 3 where the gel structure has a drug entrapped therein which by movement of the center of mass of the gel structure is propelled from the passageway in the gel structure for introduction into a patient for controlled release of the drug into the patient.

7. The method of claim 3 where a solid object is attached to the gel structure and pulled or pushed through the passageway by the movement of the gel structure.

8. The method of claim 3 where said at least one wall is the inner wall of a tube.

9. A method for propagating movement of an elongated gel structure having a first end and an other end, in the direction of its length, comprising applying one or more external stimuli starting at its first end and thereafter progressively along its length to the other end, to cause a volume phase transition in the gel structure along its length to move the center of mass of the gel structure in the direction of successive applications, where only a portion of the elongated gel structure is subjected to volume phase transition which is reversed before a next portion of the elongated gel structure is subjected to volume phase transition.

10. The method of claim 3 where said at least one wall comprises an inner flexible wall of an annular structure and the induction of volume phase transition moves the flexible wall to induce movement of a liquid through a central opening of the annular structure.

11. Pushing or pulling apparatus comprising:

(a) confining structure, (b) reversibly collapsible gel structure within the confining structure, (c) a load upstream or downstream of the gel structure, (d) stimulus applicator for causing collapsing and/or swelling of the gel structure;

whereby operation of stimulus applicator progressively collapses and swells the gel structure to move the load.

12. The pushing or pulling apparatus of claim 11 comprising a plurality of confining structures of one scale, to obtain the motion/response/force of a structure of this dimension for moving a load of larger scale, where the load has a cross section and gel structures in the confining structures together have a cross section equal to or lesser than that of the load.

13. Load moving apparatus comprising:

(a) a housing having an outer surface, (b) reversibly collapsible gel structure in moving causing or mediating relationship with the housing, (c) stimulus applicator in said housing for causing collapsing and/or swelling of the gel structure, (d) a load inside said housing, whereby operation of the stimulus applicator successively and progressively collapses and/or swells the gel structure to move the housing and the load.

14. Apparatus as claimed in claim 13 here the housing is flexible and outer surface thereof is coated with the gel structure.

15. Apparatus as claimed in claim 13 where the gel structure is contained in flexible receptacles in engagement with said outer surface.

16. Ratchet device comprising:

(a) notched wheel, (b) pawl having a notched wheel engaging end and an other end, (c) collapsible gel structure having one end attached to the other end of the pawl and other end for attachment to an immobile surface, whereby alternately collapsing and swelling of the gel causes the notched wheel to move clockwise.

17. The method of claim 1 where the elongated gel structure is reversibly collapsible.

18. The method of claim 1 where the elongated gel structure is unattached to other structure at its ends.

19. The method of claim 1 where the external stimuli are applied to cause net displacement of the gel or its center of mass.

20. The method of claim 1 where the external stimuli are applied to alternately provide a collapsed gel and a swelled gel.

21. The method of claim 1 where volume phase transition occurs at a critical value for stimulation.

22. The method of claim 21 where the critical value for stimulation is a phase transition temperature for the gel structure within 15° C. of room temperature.

23. The method of claim 3 where the ends of the elongated gel structure are unattached to other structure and the movement caused results in net displacement of the gel or its center of mass.

24. The method of claim 16 where the gel structure is a reversibly collapsible gel structure.

25. The method of claim 1 wherein the successive applications cause the gel to be collapsed in one part while simultaneously being swelled in another part.

26. The method of claim 25 where stimulus application is carried out to produce swelling of gel structure in a portion to anchor that swelled portion.

* * * * *